US006099390A

United States Patent [19]

Nishio et al.

[11] Patent Number: 6,099,390

[45] Date of Patent: Aug. 8, 2000

[54] POLISHING PAD FOR SEMICONDUCTOR WAFER AND METHOD FOR POLISHING SEMICONDUCTOR WAFER

[75] Inventors: Mikio Nishio; Tomoyasu Murakami, both of Osaka, Japan

[73] Assignee: Matsushita Electronics Corporation, Osaka, Japan

[21] Appl. No.: 09/285,647

[22] Filed: Apr. 5, 1999

[30] Foreign Application Priority Data

Oct. 6, 1997 [JP] Japan ..... 9-272482
Jun. 12, 1998 [JP] Japan ..... 10-164581

[51] Int. Cl.[7] ..... B24B 1/00; B24D 11/00

[52] U.S. Cl. ..... 451/36; 451/41; 451/59; 451/527; 451/533; 451/550

[58] Field of Search ..... 451/36, 41, 59, 451/63, 526, 527, 529, 530, 533, 548, 550

[56] References Cited

U.S. PATENT DOCUMENTS

| | | | |
|---|---|---|---|
| 1,924,597 | 8/1933 | Drake | 451/550 |
| 3,921,342 | 11/1975 | Day | 451/550 |
| 4,055,029 | 10/1977 | Kalbow | 451/527 |
| 5,020,283 | 6/1991 | Tuttle | 451/550 |
| 5,022,191 | 6/1991 | Broido | 451/550 |
| 5,177,908 | 1/1993 | Tuttle | 451/550 X |
| 5,212,910 | 5/1993 | Breivogel et al. . | |
| 5,297,364 | 3/1994 | Tuttle | 451/527 |
| 5,609,517 | 3/1997 | Lofaro | 451/529 |
| 5,910,471 | 6/1999 | Christianson et al. | 451/529 X |

FOREIGN PATENT DOCUMENTS

| | | |
|---|---|---|
| 57-132968 | 8/1982 | Japan . |
| 61-187657 | 11/1986 | Japan . |
| 5-212669 | 8/1993 | Japan . |
| 7-256560 | 10/1995 | Japan . |
| 8-216029 | 8/1996 | Japan . |
| 10-71561 | 3/1998 | Japan . |
| 10-315119 | 12/1998 | Japan . |
| 10-329005 | 12/1998 | Japan . |
| 10-329007 | 12/1998 | Japan . |
| 10-337651 | 12/1998 | Japan . |

*Primary Examiner*—Timothy V. Eley
*Attorney, Agent, or Firm*—Eric J. Robinson; Nixon Peabody LLP

[57] ABSTRACT

A polishing pad used for polishing a film on a semiconductor wafer and made of a plastic includes a polishing pad body, and a large number of convex portions, which are provided on the surface of the polishing pad body just like so many islands and each have a flat top surface. An average length L of respective sides or diameters of the convex portions on the top surface thereof is in the range from 0.1 mm to 5.0 mm, both inclusive; an average height H of the convex portions is in the range from 0.1 mm to 0.5 mm, both inclusive; and $H \leqq L \leqq 2S$ is met, where S is an average space between the convex portions.

16 Claims, 13 Drawing Sheets

POLISHING PAD FOR SEMICONDUCTOR WAFER AND METHOD FOR POLISHING SEMICONDUCTOR WAFER

BACKGROUND OF THE INVENTION

The present invention relates to a polishing pad for use in chemical/mechanical polishing (CMP) to polish and planarize a film on a semiconductor wafer during the manufacturing process of semiconductor devices, and to a method for polishing a semiconductor wafer using the polishing pad.

For the last decade since 1990, the diameter of a semiconductor wafer, typically a silicon wafer, processable by CMP during the manufacturing process of semiconductor devices has continued to increase to exceed 150 mm, and single-wafer polishing is going to replace multiple-wafer polishing day by day. In addition, the design rule of a pattern formed on a semiconductor wafer has been drastically reduced over the past few years to 0.5 $\mu$m or less. Under the circumstances such as these, it has become more and more necessary to further planarize a level difference formed on a semiconductor wafer during the manufacturing process of semiconductor devices.

Hereinafter, a conventional semiconductor wafer polisher will be described with reference to FIG. 10.

FIG. 10 illustrates a schematic arrangement for a conventional semiconductor wafer polisher. As shown in Figure 10, a platen 101 includes: a pad mount 110*a* made of a rigid material with a flat surface; a rotation axis 101*b* extending vertically downward from the lower surface of the pad mount 110*a*; and a motor (not shown) for rotating the rotation axis 101*b*. An elastic polishing pad 102 is attached to the upper surface of the pad mount 110*a* of the platen 101. A wafer holder head 104 for holding a semiconductor wafer 103 thereon is provided over the polishing pad 102. The wafer 103 is pressed against the pad 102 while being rotated by the wafer holder head 104. Polishing slurry 105 is supplied through a slurry supply tube 106 every time by a predetermined amount and dripped onto the pad 102 to polish the wafer 103.

In this polisher, the pad 102 is rotated along with the rotating platen 101, and at the same time, the wafer 103, held by the wafer holder head 104, is rotated and pressed against the pad 102 with the slurry 105 supplied onto the pad 102. As a result, a film to be polished on the wafer 103 continues to receive pressure at a certain relative velocity so as to be polished.

If the surface of the film to be polished on the wafer 103 has some roughness, then such roughness of the film on the wafer 103 can be reduced through this polishing process and the film on the wafer 103 is planarized. This is because convex portions of the film are more likely to be polished since the contact pressure between such portions and the pad 102 is relatively high, while concave portions thereof are less likely to be polished since the contact pressure therebetween is relatively low. This polishing technique is described in Monthly Semiconductor World, January 1994, pp. 58–59 and in Solid State Technology, July 1992, pp. 32–37 (in Japanese), for example.

Hereinafter, a conventional polishing pad will be described. Polishing pads of various types, including suede types, non-woven fabric types and plastic-plate types, are 10 available. Among other things, a polishing pad made of a plastic is used most often, because polishing pads of suede and non-woven fabric types are soft and easily deformed.

That is to say, if a polishing pad of any of these types is used, then the polishing pad is more likely to come into con15 tact with the concave portions on the surface of the semiconductor wafer during the polishing process, resulting in insufficient planarity.

Thus, a polishing pad of a plastic plate type, made of a foamed plastic with a sufficient degree of hardness, for ex20 ample, is often used for planarizing the surface of a semiconductor wafer. For instance, a polishing pad made of foamed urethane is employed particularly frequently.

In using a polishing pad of a plastic plate type, made of foamed urethane, however, as the pad is used longer, the surface state of the pad gradually deteriorates, i.e., the surface is glazed, or worn out to be flattened. As a result, the capacity of the pad to hold the polishing slurry thereon declines correspondingly. In other words, since the amount of the polishing slurry supplied to a polishing region, where the surfaces of the polishing pad and the semiconductor wafer are in contact with each other, decreases, the rate at which the surface of the wafer is polished, or polishing efficiency, also decreases.

Accordingly, once the surface of a polishing pad has been glazed, the polishing rate should be improved and stabilized by rejuvenating the surface through dressing. "Dressing" is a treatment to roughen the surface of a polishing pad again by partially cutting off, or giving fine scratches to, the surface of the polishing pad using a plate embedded with fine diamond powder. As a result of this dressing, the surface of the polishing pad can regain its capacity to hold the polishing slurry thereon and the polishing rate can retain or recover its original rate.

FIG. 11 illustrates respective relationships between the number of semiconductor wafers processed and the polishing rate with or without a polishing pad dressed. In this case, the "polishing rate" is defined as a decrease in thickness of a film per unit time. If the polishing pad is not dressed, the polishing rate declines as the number of wafers processed increases. In contrast, if the polishing pad is dressed, even if the number of wafers processed increases, the polishing ate is substantially constant.

However, even if the glazed surface of a polishing pad is rejuvenated through dressing, the following problems happen.

FIG. 12 illustrates how the surface of a semiconductor wafer 103 is polished using a polishing pad 102 with the surface rejuvenated through dressing. Once the glazed surface of the polishing pad 102 has been rejuvenated through dressing, fine roughness is created on the surface of the pad 102 as shown in FIG. 12. However, observing this surface microscopically, the roughness is very irregular and the height of the tallest concave portions reaches as large as several tens micrometers. That is to say, the surface of the pad 102, which has been rejuvenated through dressing, is fluffed up.

If the surface of a semiconductor wafer 103 with a level difference thereon is polished using such a fluffy polishing pad 102, then the following problems are caused. Specifically, the level difference on the surface of the wafer 103 is at most 1 or 2 $\mu$m, whereas the height of the convex portions on the polishing pad 102 reaches several tens micrometers. Accordingly, when the wafer 103 is pressed against such a pad 102, the convex portions of the pad 102 are deformed to track the roughness on the surface of the wafer 103 or come into contact with the concave portions of the wafer 103. Consequently, the concave portions of the wafer 103 are also polished unintentionally and the level difference of the wafer 103 cannot be planarized satisfactorily. Thus, the performance of the pad 102 in planarizing the level difference through polishing deteriorates to the contrary as a result of dressing.

As can be seen, if the pad 102 is dressed, then the number of wafers processed increases and the polishing rate is stabilized. But the performance of the pad 102 in planarizing the level difference of the wafer 103 deteriorates, because the surface of the pad 102 gets fluffy.

In order to eliminate the necessity of dressing a polishing pad, the present inventors proposed a polishing pad 110 shown in FIG. 13. As shown in FIG. 13, the polishing pad 110 includes: flat convex portions 110*a* that come into contact with only the convex portions of a semiconductor wafer 103, not the concave portions thereof; and concave portions 110*b* provided between the convex portions 110*a* for storing polishing slurry 105 therein. In FIG. 13, the open circles in the slurry 105 are abrasive grains. According to the pad 110 shown in FIG. 13, the convex portions 110*a* do not come into contact with the concave portions of the wafer 103 and the slurry 105 can be held in the concave portions 110*b*.

However, if the wafer 103 is polished with the pad 110 shown in FIG. 13, then new problems happen. Specifically, even if the wafer 103 is rotated and pressed against the pad 110, the slurry 105, existing on the convex portions 110*a* of the pad 110, does not move instantaneously from the convex portions 110a into the concave portions 110*b*. As a result, the wafer 103 is floating over the pad 110 due to hydroplaning. In such a situation, no matter how strong the wafer 103 is pressed against the pad 110, the abrasive grains, contained in the slurry 105, hardly come into contact with the wafer 103, resulting in considerable decrease in the polishing rate of the wafer 103.

SUMMARY OF THE INVENTION

An object of the present invention is ensuring chemical/mechanical polishing with excellent planarizing performance and sufficiently high polishing rate maintained for a long time even if a polishing pad is not dressed for rejuvenation.

A first polishing pad according to the present invention is used for polishing a film on a semiconductor wafer and is made of a plastic. The polishing pad includes: a polishing pad body; and a large number of convex portions, which are provided on the surface of the polishing pad body just like so many islands and each have a flat top surface. An average length L of respective sides or diameters of the convex portions on the top surface thereof is in the range from 0.1 mm to 5.0 mm, both inclusive. An average height H of the convex portions is in the range from 0.1 mm to 0.5 mm, both inclusive. And $H \leqq L \leqq 2S$ is met, where S is an average space between the convex portions.

With the first polishing pad, the film to be polished on the semiconductor wafer is polished by pressing a large number of convex portions, which are provided on the surface of the polishing pad body just like so many islands and each have a flat top surface, against the film. Accordingly, the polishing pad does not have to be dressed.

In addition, the average length L of respective sides or diameters of the convex portions on the top surface thereof is in the range from 0.1 mm to 5.0 mm, both inclusive. Since the average length L may be as small as 0.1 mm, the convex portions of the polishing pad cannot enter the concave portions of the semiconductor wafer, thus improving the planarizing performance on the wafer. The average length L may also be increased up to 5.0 mm. Accordingly, when the wafer is pressed against the pad, superfluous part of the polishing slurry, existing between the respective top surfaces of the convex portions and the wafer, can move from these surfaces into the concave portions among the convex portions. That is to say, since an appropriate amount of polishing slurry always exists between the top surfaces of the convex portions and the wafer, the wafer can be ground by the abrasive grains contained in the polishing slurry. As a result, the polishing rate increases.

Moreover, the average height H of the convex portions is in the range from 0.1 mm to 0.5 mm, both inclusive. Since the average height H may be 0.1 mm or more, superfluous part of the polishing slurry, existing between the respective top surfaces of the convex portions and the wafer, can be stored in the concave portions. As a result, the wafer can be polished at a higher rate. Also, since the average height H may be increased up to 0.5 mm, the polishing slurry, which is stored in the concave portions among the convex portions, is more likely to be introduced into a polishing region between the top surfaces of the convex portions and the wafer. Accordingly, the polishing region can always be supplied with fresh polishing slurry, thus increasing the polishing rate.

Furthermore, a relationship $H \leqq L \leqq 2S$ is met among the average length L of respective sides or diameters of the convex portions on the top surface thereof; the average height H of the convex portions; and the average space S between the convex portions. That is to say, since the average height H is equal to or smaller than the average length L, the convex portions are less likely to be deformed and can come into contact with the wafer satisfactorily even if a relative velocity is caused between the pad and the wafer. As a result, the polishing rate increases. Also, since the average length L is equal to or smaller than twice the size of the average space S, superfluous part of the polishing slurry, existing between the respective top surfaces of the convex portions and the wafer, can be stored within the concave portions among the convex portions. The polishing rate also increases because of this reason.

Accordingly, by using the first polishing pad, excellent planarizing performance and sufficiently high polishing rate can be maintained for a long time even if dressing is not performed for rejuvenation.

In one embodiment of the present invention, a total area of the respective top surfaces of the convex portions preferably accounts for half or less of the entire surface area of the polishing pad body.

In such an embodiment, the pressure per unit area applied to the wafer from the convex portions of the pad gets higher. Accordingly, superfluous part of the polishing slurry, existing between the top surfaces of the convex portions and the wafer, can be stored within the concave portions among the convex portions. In addition, since the convex portions of the wafer can be ground by the abrasive grains contained in the polishing slurry with much more certainty, the polishing rate further increases.

A second polishing pad according to the present invention is also used for polishing a film on a semiconductor wafer and is made of a plastic. The polishing pad includes: a polishing pad body; a large number of concave portions, which are independently provided on the surface of the polishing pad body and store polishing slurry; and a convex portion, which is continuously provided among the concave portions on the surface of the polishing pad body. An average width W of the convex portion is in the range from 0.1 mm to 5.0 mm, both inclusive. An average height H of the convex portion is in the range from 0.1 mm to 0.5 mm, both inclusive. And $H \leqq W \leqq D/2$ is met, where D is an average size of respective sides or diameters of openings of the concave portions.

With the second polishing pad, the film to be polished on the wafer is polished by pressing the convex portion, which is continuously provided among the concave portions on the surface of the polishing pad body, against the film. Accordingly, the polishing pad does not have to be dressed.

In addition, the average width W of the convex portion is in the range from 0.1 mm to 5.0 mm, both inclusive. Since the average width W may be as small as 0.1 mm, the convex portion of the pad does not enter the concave portions of the wafer, thus improving the planarizing performance on the wafer. The average width W may also be increased up to 5.0 mm. Accordingly, when the wafer is pressed against the pad, superfluous part of the polishing slurry, existing between the top surface of the convex portion and the semiconductor wafer, can move from the top surface into the concave portions. That is to say, since an appropriate amount of polishing slurry always exists between the top surface of the convex portion and the wafer, the polishing rate increases.

Moreover, the average height H of the convex portion is in the range from 0.1 mm to 0.5 mm, both inclusive. Since the average height H may be 0.1 mm or more, superfluous part of the polishing slurry, existing between the top surface of the convex portion and the wafer, can be stored in the concave portions. As a result, the wafer can be polished at a higher rate. Also, since the average height H may be increased up to 0.5 mm, the polishing slurry, which is stored in the concave portions, is more likely to be introduced into a polishing region between the top surface of the convex portion and the wafer. Accordingly, the polishing region can always be supplied with fresh slurry, thus increasing the polishing rate.

Furthermore, a relationship $H \leqq W \leqq D/2$ is met among the average width W and height H of the convex portion and the average size D of respective sides or diameters of the openings of the concave portions. That is to say, since the average height H is equal to or smaller than the average width W, the convex portion is less likely to be deformed and can come into contact with the wafer satisfactorily even if a relative velocity is caused between the pad and the wafer. As a result, the polishing rate increases. Also, since the average width W is equal to or smaller than half the size of the average size D, superfluous part of the polishing slurry, existing between the top surface of the convex portion and the wafer, can be stored within the concave portions. The polishing rate also increases because of this reason.

Accordingly, by using the second polishing pad, excellent planarizing performance and sufficiently high polishing rate can be maintained for a long time even if dressing is not performed for rejuvenation.

In one embodiment of the present invention, a total area of the top surface of the convex portion preferably accounts for half or less of the entire surface area of the polishing pad body.

In such an embodiment, the pressure per unit area applied to the wafer from the convex portion of the pad gets higher. Accordingly, superfluous part of the polishing slurry, existing between the top surface of the convex portion and the wafer, can be stored within the concave portions among respective parts of the convex portion. In addition, since the convex portions of the wafer can be ground by the abrasive grains contained in the polishing slurry with much more certainty, the polishing rate further increases.

In another embodiment of the present invention, a minimum width Wmin of the convex portion is preferably equal to or larger than the average height H of the convex portion.

In such an embodiment, the convex portion of the pad is less likely to enter the concave portions of the wafer, thus further improving the planarizing performance.

A first method for polishing a semiconductor wafer according to the present invention includes the step of polishing a film on the semiconductor wafer using a polishing pad made of a plastic. The polishing pad includes: a polishing pad body; and a large number of convex portions, which are provided on the surface of the polishing pad body just like so many islands and each have a flat top surface. An average length L of respective sides or diameters of the convex portions on the top surface thereof is in the range from 0.1 mm to 5.0 mm, both inclusive. An average height H of the convex portions is in the range from 0.1 mm to 0.5 mm, both inclusive. And $H \leqq L \leqq 2S$ is met, where S is an average space between the convex portions.

In accordance with the first method, since the first polishing pad is used, polishing can be carried out with excellent planarizing performance and sufficiently high polishing rate maintained for a long time even if dressing is not performed for rejuvenation.

In one embodiment of the present invention, a total area of the respective top surfaces of the convex portions preferably accounts for half or less of the entire surface area of the polishing pad body. Then, the polishing rate further increases.

In another embodiment where the film to be polished on the semiconductor wafer is a silicon dioxide film, the average length L is preferably in the range from 0.1 mm to 0.5 mm, both inclusive. In such an embodiment, since polishing on the silicon dioxide film can be promoted due to mechanical factors, the polishing rate further increases.

In still another embodiment where the film to be polished on the semiconductor wafer is a copper film or a copper alloy film, the average length L is preferably in the range from 0.5 mm to 5.0 mm, both inclusive. In such an embodiment, since polishing can be promoted due to chemical factors, the polishing rate further increases.

In still another embodiment where the film to be polished on the semiconductor wafer is a tungsten film or a tungsten silicide film, the average length L is preferably in the range from 0.1 mm to 2.0 mm, both inclusive. In such an embodiment, since polishing can be promoted due to both mechanical and chemical factors in balance, the polishing rate increases even more.

A second method for polishing a semiconductor wafer according to the present invention includes the step of polishing a film on the semiconductor wafer using a polishing pad made of a plastic. The polishing pad includes: a polishing pad body; a large number of concave portions, which are independently provided on the surface of the polishing pad body and store polishing slurry; and a convex portion, which is continuously provided among the concave portions on the surface of the polishing pad body. An average width W of the convex portion is in the range from 0.1 mm to 5.0 mm, both inclusive. An average height H of the convex portion is in the range from 0.1 mm to 0.5 mm, both inclusive. And $H \leqq W \leqq D/2$ is met, where D is an average size of respective sides or diameters of openings of the concave portions.

In accordance with the second method, since the second polishing pad is used, polishing can be carried out with excellent planarizing performance and sufficiently high polishing rate maintained for a long time even if dressing is not performed for rejuvenation.

In one embodiment of the present invention, a total area of the top surface of the convex portions preferably accounts for half or less of the entire surface area of the polishing pad body. Then, the polishing rate further increases.

In another embodiment of the present invention, a minimum width Wmin of the convex portion is equal to or larger than the average height H of the convex portion. Then, the planarizing performance can be further improved.

In still another embodiment where the film to be polished on the semiconductor wafer is a silicon dioxide film, the average width W is preferably in the range from 0.1 mm to 0.5 mm, both inclusive. Then, the polishing rate further increases.

In still another embodiment where the film to be polished on the semiconductor wafer is a copper film or a copper alloy film, the average width W is preferably in the range from 0.5 mm to 5.0 mm, both inclusive. Then, the polishing rate further increases.

In still another embodiment where the film to be polished on the semiconductor wafer is a tungsten film or a tungsten silicide film, the average width W is preferably in the range from 0.1 mm to 2.0 mm, both inclusive. Then, the polishing rate further increases.

BRIEF DESCRIPTION OF THE DRAWINGS

FIG. 1(*b*) is a cross-sectional view of the pad taken along the line Ib—Ib in FIG. 1(*a*).

FIG. 5(*b*) is a cross-sectional view of the pad taken along the line Vb—Vb in FIG. 5(*a*).

FIG. 7(*b*) is a cross-sectional view of the pad taken along the line VIIb—VIIb in FIG. 7(*a*).

FIG. 9(*b*) is a cross-sectional view of the pad taken along the line Ixb—IXb in FIG. 9(*a*); and FIG. 9(*c*) is another cross-sectional view of the pad taken along the line Ixb—IXb in FIG. 9(*a*).

DESCRIPTION OF THE PREFERRED EMBODIMENTS

Embodiment 1

Figure 1A:
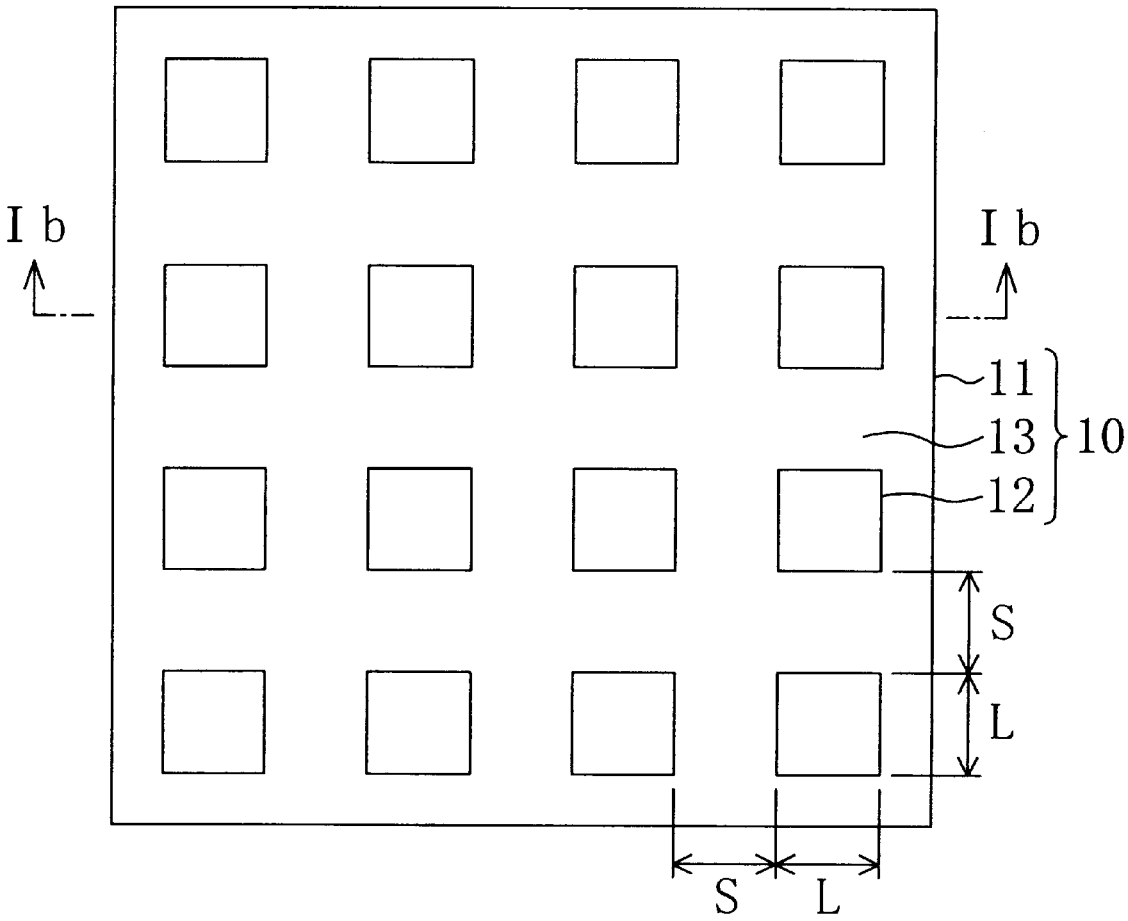
FIG. 1(*a*) is a plan view of a polishing pad for semiconductor wafer according to the first embodiment of the present invention.
Figure 1B:
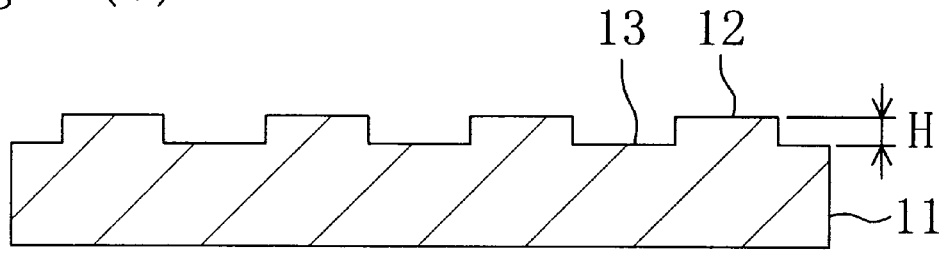

Hereinafter, polishing pad for semiconductor wafer and method for polishing a semiconductor wafer using the polishing pad according to the first embodiment of the present invention will be described with reference to FIGS. 1(*a*) and 1(*b*), FIG. 2 and FIG. 3. FIG. 1(*a*) is a plan view of a polishing pad 10 of the first embodiment; and FIG. 1(*b*) is a cross-sectional view thereof taken along the line Ib—Ib in FIG. 1(*a*).

The polishing pad 10 includes a polishing pad body 11, a large number of convex portions 12 and concave portions 13. The polishing pad body 11 is made of a non-foamed plastic such as polyurethane or acrylate resin. The convex portions 12 are provided on the surface of the polishing pad body 11 just like so many islands and each have a flat top surface. And the concave portions 13 exist among the convex portions 12 on the surface of the polishing pad body 11. The planar shape of each of the convex and concave portions 12 and 13 is not limited to any particular shape. That is to say, these portions 12 and 13 may be square, rectangular, polygonal, circular or ellipsoidal. Alternatively, a plurality of planar shapes may be applied to these portions 12 and 13 in combination.

In this embodiment, an average length L of respective sides or diameters of the convex portions 12 on the top surface thereof is in the range from 0.1 mm to 5.0 mm, both inclusive. An average height H of the convex portions 12 is in the range from 0.1 mm to 0.5 mm, both inclusive. And $H \leqq L \leqq 2S$ is met, where S is an average space between the convex portions 12. Also, the total area of the respective top surfaces of the convex portions 12 preferably accounts for half or less of the entire surface area of the polishing pad body 11. The reasons why these relationships should be established will be described in detail later with reference to FIGS. 2 and 3.

First, the average length L of respective sides or diameters of the convex portions 12 on the top surface thereof will be described as a premise. The average length L is defined in respectively different manners depending on the specific shape of the top surface of each convex portion 12. For example, if the top surface of a convex portion 12 is square, then the average length L is equal to the length of each side. If the top surface of a convex portion 12 is rectangular, then the average length L is an average between the longer and shorter sides thereof. If the top surface of a convex portion 12 is polygonal, then the average length L is an average among respective diagonals thereof. If the top surface of a convex portion 12 is circular, then the average length L is equal to the diameter thereof. And if the top surface of a convex portion 12 is ellipsoidal, then the average length L is an average between the longer and shorter axes thereof.

Figure 2:
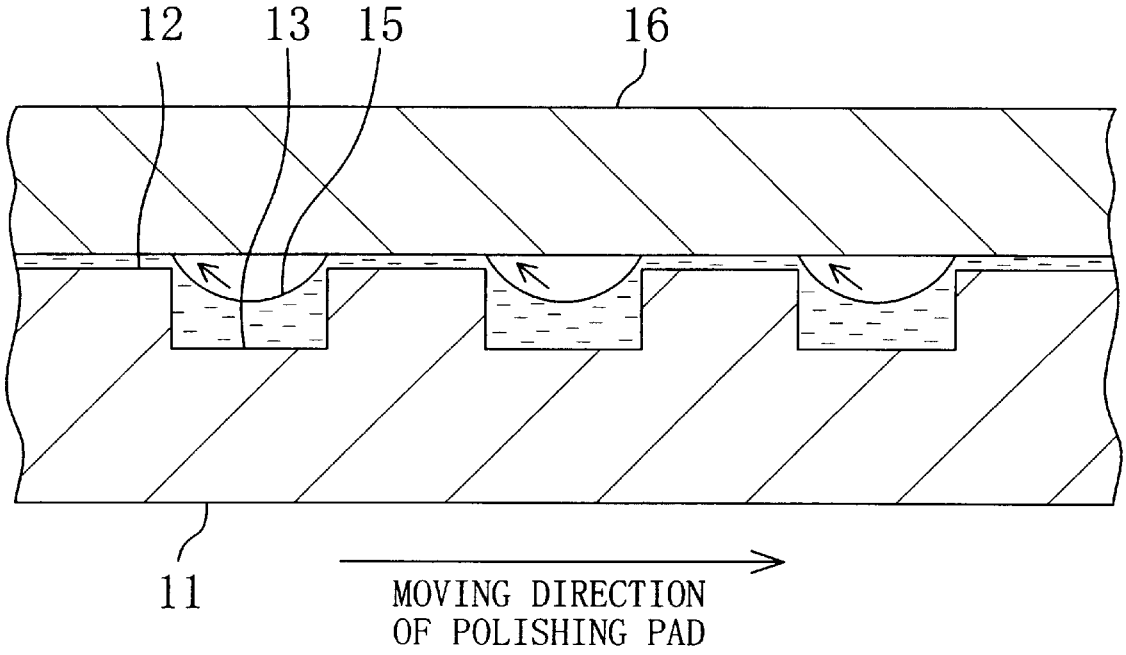
FIG. 2 is a cross-sectional view illustrating a mechanism, by which polishing slurry is supplied to a polishing region during a process of polishing a semiconductor wafer using the polishing pad of the first embodiment.

FIG. 2 illustrates a mechanism, by which polishing slurry 15 is supplied to a polishing region during a process of polishing a semiconductor wafer 16 using the polishing pad 10 of the first embodiment. The polishing slurry 15, supplied onto the surface of the polishing pad body 11 of the polishing pad 10, is stored within the concave portions 13 among the convex portions 12. Since some tension is caused on the surface of the slurry 15 stored in the concave portions 13, the surface sinks to show a U-shaped cross section. During polishing, a relative velocity is caused between the pad 10 and the wafer 16. Thus, supposing the pad 10 is moving rightward in FIG. 2, the slurry 15, which has been stored in a concave portion 13, moves toward the top surface of a convex portion 12 located on the left thereof (i.e., into the polishing region) due to the surface tension. Thereafter, the slurry 15 is settled within the concave portion 13 located on the left of the convex portion 12. In this manner, as the pad 10 and the wafer 16 are being rotated relative to each other, the slurry 15 is successively introduced from the concave portions 13 into the polishing regions. As a result, the polishing regions are always supplied with fresh polishing slurry 15.

Figure 3:
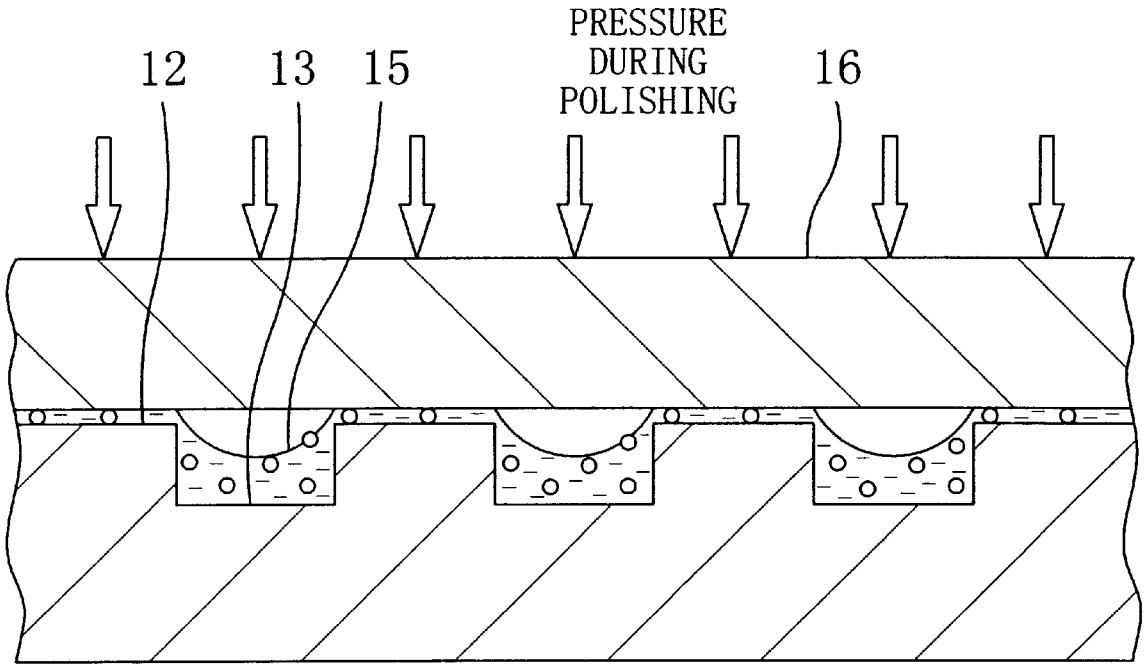
FIG. 3 is a cross-sectional view illustrating a mechanism, by which superfluous part of the polishing slurry is transferred from the polishing region into concave portions during the process of polishing the semiconductor wafer using the polishing pad of the first embodiment.
Figure 12:
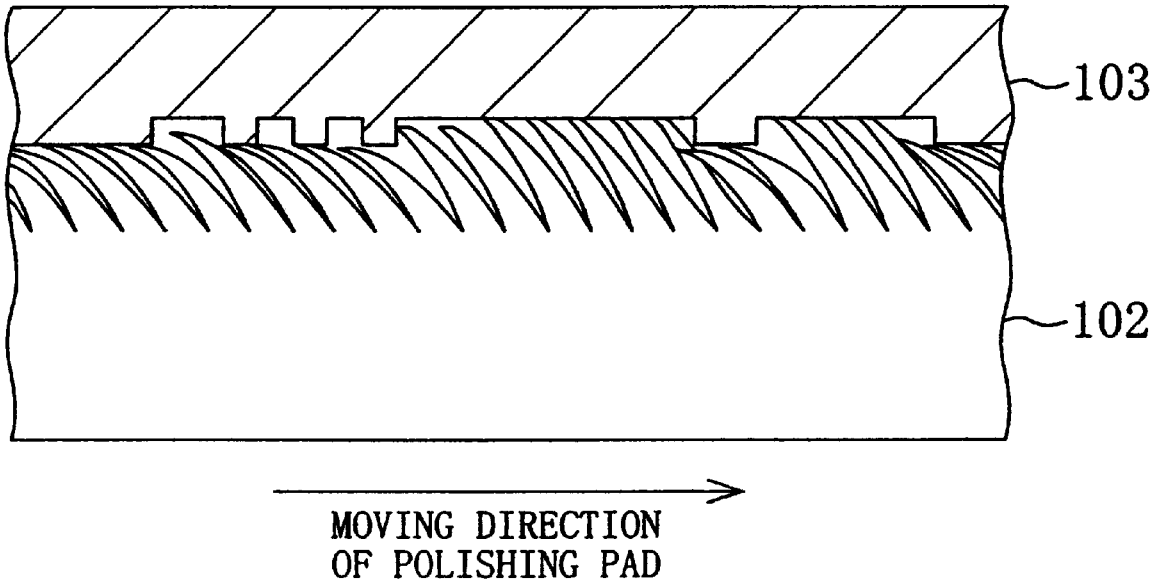
Fig. 12 PRIOR ART
FIG. 12 is a cross-sectional view illustrating how a semiconductor wafer is polished with a polishing pad rejuvenated through dressing.
Figure 13:
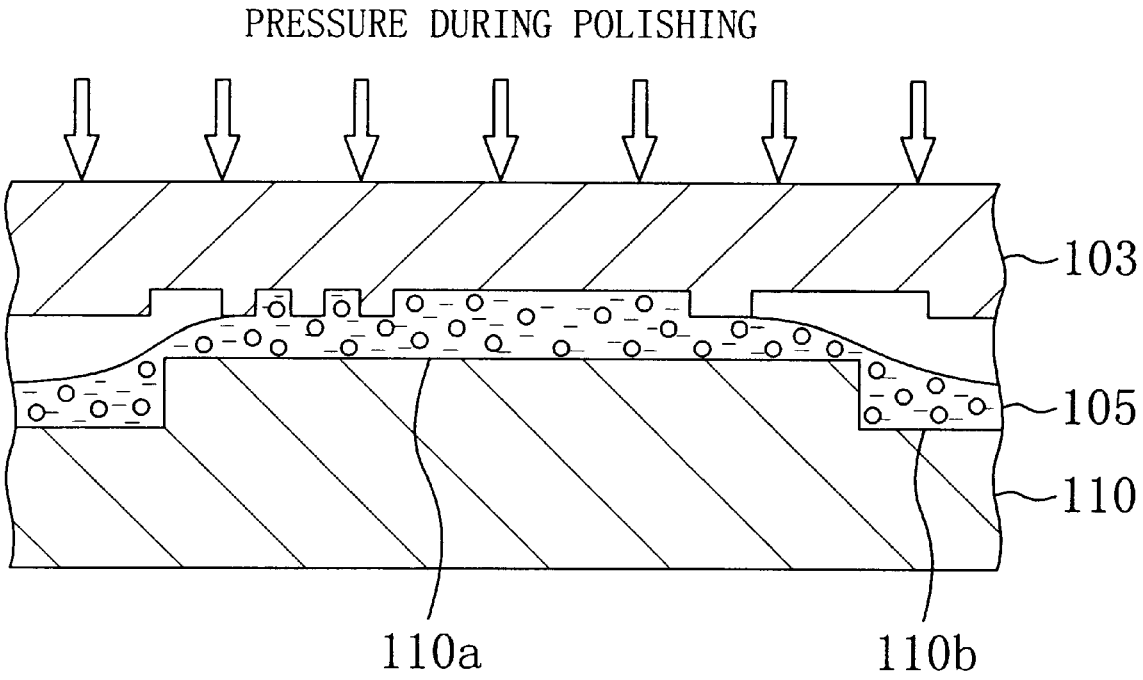
FIG. 13 is a cross-sectional view illustrating a polishing pad for semiconductor wafer as a basis of the present invention.

FIG. 3 illustrates a mechanism, by which superfluous part of the polishing slurry 15 is transferred from the polishing regions into the concave portions 13 during the process of polishing the semiconductor wafer 16 using the polishing pad 10 of the first embodiment. As shown in FIG. 3, the superfluous part of the slurry 15, existing between the top surfaces of the convex portions 12 and the wafer 16, is transferred into adjacent concave portions 13 owing to the pressure applied to the wafer 16 against the pad 10. (Reason why 0.1 mm≦L≦5.0 mm should be met) If the average length L of respective sides or diameters of the convex portions 12 on the top surface thereof in the polishing pad 10 is smaller than 0.1 mm, then the convex portions 12 of the polishing pad 10 are likely to enter the concave portions of the semiconductor wafer 16 as in the conventional polishing pad shown in FIG. 12. As a result, the concave portions of the wafer 16 are also polished unintentionally, the level difference of the wafer 16 is harder to eliminate and the performance of the pad 10 in planarizing the wafer 16 considerably deteriorates. In contrast, if the average length L is 0.1 mm or more, then the convex portions 12 of the pad 10 are less likely to enter the concave portions of the wafer 16. As a result, the performance of the pad 10 in planarizing the wafer 16 improves.

On the other hand, suppose the average length L is larger than 5.0 mm. Then, even if the wafer 16 is pressed against the pad 10, superfluous part of the polishing slurry 15, existing between the top surfaces of the convex portions 12 and the wafer 16, is more likely to remain on the top surfaces of the convex portions 12, thus causing hydroplaning. As a result, the wafer 16 is floating over the pad 10, the abrasive grains, contained in the polishing slurry 15, hardly come into contact with the wafer 16 and the polishing rate of the wafer 16 greatly decreases. In contrast, suppose the average length L is 5.0 mm or less. Then, when the wafer 16 is pressed against the pad 10, superfluous part of the polishing slurry 15, existing between the top surfaces of the convex portions 12 and the wafer 16, quickly move from the top surfaces of the convex portions 12 into adjacent concave portions 13. As a result, an appropriate amount of polishing slurry 15 always exists between the top surfaces of the convex portions 12 and the wafer 16. In addition, the abrasive grains, contained in the slurry 15, can come into contact with the wafer 16, thus increasing the polishing rate of the wafer 16.

(Reason why 0.1 mm≦H≦0.5 mm should be met)

If the average height H of respective convex portions 12 of the polishing pad 10 is smaller than 0.1 mm, then the depth of the concave portions 13 is too small to store an appropriate amount of polishing slurry 15 therein. Accordingly, superfluous part of the polishing slurry 15, existing between the top surfaces of the convex portions 12 and the wafer 16, is more likely to remain on the top surfaces of the convex portions 12. As a result, the wafer 16 is floating over the pad 10 and the polishing rate of the wafer 16 greatly decreases. In contrast, suppose the average height H is 0.1 mm or more. Then, that superfluous part of the polishing slurry 15, existing between the top surfaces of the convex portions 12 and the wafer 16, can be stored in the concave portions 13 with much more certainty. As a result, the polishing rate of the wafer 16 increases.

On the other hand, suppose the average height H is larger than 0.5 mm. Then, the polishing slurry 15, which is stored in the concave portions 13, is less likely to be introduced into the polishing regions between the top surfaces of respective convex portions 12 and the wafer 16. That is to say, it becomes harder to supply fresh polishing slurry 15 to the polishing regions, resulting in decrease in polishing rate. In contrast, suppose the average height H is 0.5 mm or less. Then, the polishing slurry 15, which is stored in the concave portions 13, is more likely to be introduced into the polishing regions between the top surfaces of respective convex portions 12 and the wafer 16. Accordingly, the polishing regions can always be supplied with fresh polishing slurry 15, resulting in increase in polishing rate.

(Reason why H≦L≦2S should be met)

Suppose the average height H of the convex portions 12 of the polishing pad 10 is larger than the average length L of respective sides or diameters of the convex portions 12 on the top surface thereof. Then, the convex portions 12 are more likely to be deformed when a relative velocity is caused between the pad 10 and the wafer 16 during polishing. That is to say, the top surfaces of the convex portions 12 are less likely to come into contact with the wafer 16, thus decreasing the polishing rate of the wafer 16. In contrast, suppose the average height H is equal to or smaller than the average length L. Then, the convex portions 12 are less likely to be deformed even if a relative velocity is caused between the pad 10 and the wafer 16. That is to say, the top surfaces of the convex portions 12 can come into good contact with the wafer 16, thus increasing the polishing rate of the wafer 16.

On the other hand, suppose the average length L is of a size more than twice of the average space S between the convex portions 12. Then, the amount of polishing slurry 15 stored in the concave portions 13 decreases. Accordingly, superfluous part of the polishing slurry 15, existing between the top surfaces of the convex portions 12 and the wafer 16, is more likely to remain on the top surfaces of the convex portions 12. As a result, the wafer 16 is floating over the pad 10 and the polishing rate of the wafer 16 greatly decreases. In contrast, suppose the average length L is of a size twice or less of the average space S. Then, that superfluous part of the polishing slurry 15, existing between the top surfaces of the convex portions 12 and the wafer 16, can be stored in the concave portions 13 with much more certainty. As a result, the polishing rate of the wafer 16 increases.

(Reason why the total area of the top surfaces of the convex portions 12 should be half or less of the entire surface area of the polishing pad body 11)

If the total area of the top surfaces of the convex portions 12 is half or less of the entire surface area of the polishing pad body 11, then the wafer 16 receives larger pressure per unit area from the convex portions 12 of the pad 10 when the wafer 16 is pressed against the pad 10. As a result, the superfluous part of the polishing slurry 15, existing between the top surfaces of the convex portions 12 and the wafer 16, can be stored in the concave portions 13 with much more certainty. In addition, since the convex portions of the wafer 16 can be ground by the abrasive grains contained in the polishing slurry 15 with a lot more certainty, the polishing rate of the wafer 16 increases.

(Methods for manufacturing the polishing pad 10)

The polishing pad 10 may be manufactured by any of the following methods. For example, in accordance with a method, parts of the polishing pad body 11, where the concave portions 13 should be formed, may be cut off by machining. According to another method, the polishing pad body 11, whose surface is still flat, may be pressed against a die having concave portions to receive respective parts of the polishing pad body 11 where the convex portions 12 should be formed. Still another method is pouring a molding resin into a die having concave portions to shape respective parts of the polishing pad body 11 where the convex portions 12 should be formed. In accordance with the second method, i.e., pressing the polishing pad body 11 against the die, the convex portions 12 can be formed on the surface of the polishing pad body 11 more easily if the body 11 has been heated in advance.

(Relationship between the average length L of respective sides or diameters of the convex portions 12 on the top surface thereof and the type of a film to be polished)

The foregoing size relationships are generally applicable irrespective of the type of the film to be polished. If the type of a film to be polished is specified, however, the average length L of respective sides or diameters of the convex portions 12 on the top surface thereof should preferably be further limited within a narrower range.

If a silicon dioxide film should be polished, then 0.1 mm≦L≦0.5 mm should be met. This is because when a silicon dioxide film is polished by CMP, the film is polished due to not so much chemical factors as mechanical factors. That is to say, in order to promote mechanical polishing, the average length L should be smaller in such a case. Also, since a silicon dioxide film is hard, the convex portions 12 are less likely to be forced into the film to be polished even if the average length L is small.

On the other hand, if a copper or copper alloy film should be polished, then 0.5 mm≦L≦5.0 mm should be met. This is because when a copper or copper alloy film is polished by CMP, the film is polished due to not so much mechanical factors as chemical factors. That is to say, in order to promote chemical polishing, the contact area between the slurry 15 and the wafer 16 should be expanded by increasing the average length L. Also, since a copper or copper alloy film is soft, the convex portions 12 are possibly forced into the film to be polished if the average length L is small.

Furthermore, if a tungsten or tungsten silicide film should be polished, then 0.1 mm≦L≦2.0 mm should be met. This is because when a tungsten or tungsten silicide film is polished by CMP, the film is polished due to not so much chemical factors as mechanical factors compared with polishing a copper or copper alloy film. Also, a tungsten or tungsten silicide film is harder than a copper or copper alloy film. Accordingly, even if the average length L is small, the convex portions 12 are less likely to be forced into the film to be polished in this case.

Embodiment 2

Figure 4:
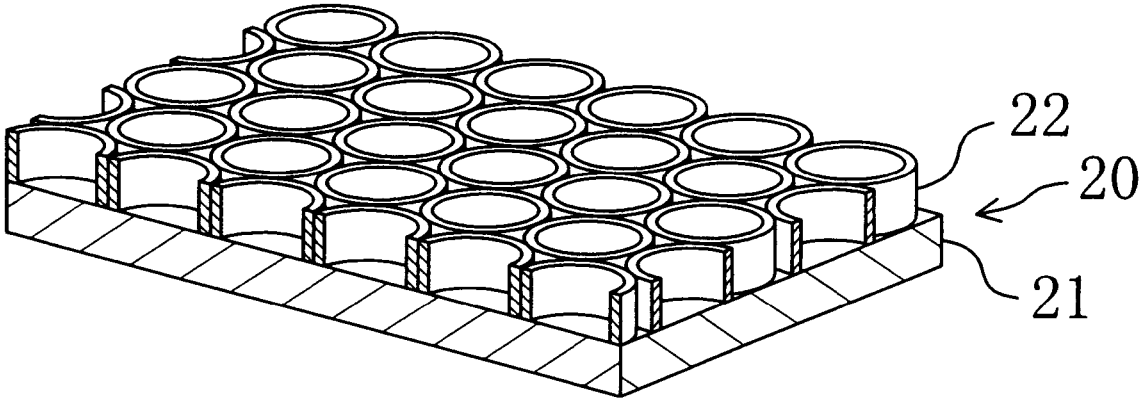
FIG. 4 is a perspective sectional view of a polishing pad for semiconductor wafer according to the second embodiment of the present invention.
Figure 5A:
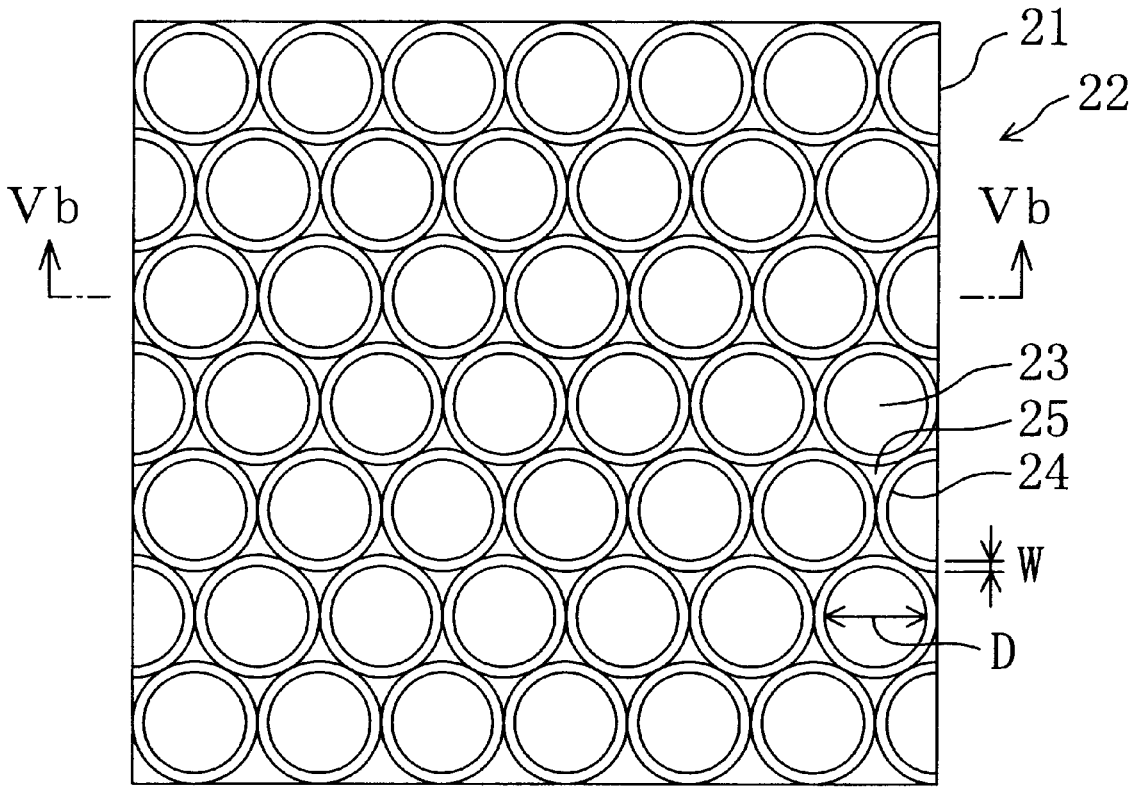
FIG. 5(*a*) is a plan view of the polishing pad of the second embodiment.
Figure 5B:
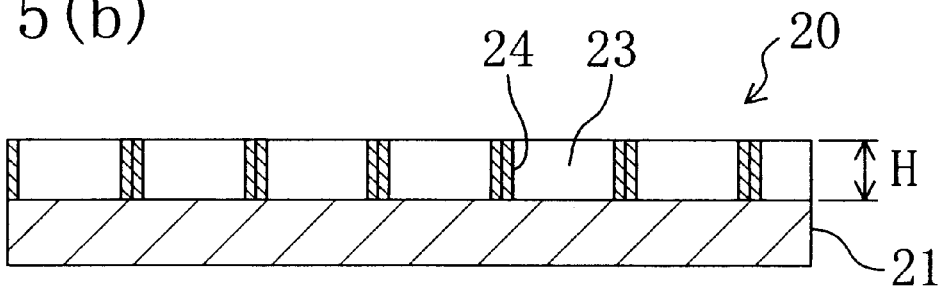

Next, polishing pad for semiconductor wafer and method for polishing a semiconductor wafer using the polishing pad according to the second embodiment of the present invention will be described with reference to FIG. 4 and FIGS. 5(*a*) and 5(*b*). FIG. 4 is a perspective sectional view of a polishing pad 20 of the second embodiment. FIG. 5(*a*) is a plan view of the polishing pad 20; and FIG. 5(*b*) is a cross-sectional view thereof taken along the line Vb—Vb in FIG. 5(*a*).

The polishing pad 20 includes a polishing pad body 21 made of a non-foamed plastic such as polyurethane or acrylate resin, and a large number of cylindrical members 22, which are provided on the surface of the polishing pad body 21. A large number of concave portions 23 are formed in this embodiment by the hollows of these cylindrical members 22. And the concave portions 23 are independently provided on the surface of the polishing pad body 21 to store the polishing slurry therein. Also, a convex portion 24 is formed in this embodiment by the sidewalls of the cylindrical members 22. The convex portion 24 is continuously provided among the concave portions 23 on the surface of the polishing pad body 21. It should be noted that the gaps 25 among the cylindrical members 22 are not large enough to store the polishing slurry and therefore do not belong to the concave portions 23. The cross-sectional shape of each of the cylindrical members 22 is not limited to any particular shape. That is to say, the cross-sectional shape of the cylindrical members 22 may be circular, ellipsoidal, square, rectangular or polygonal. Alternatively, a plurality of cross-sectional shapes may be applied to the cylindrical members 12 in combination.

In this embodiment, an average width W of the convex portion 24 is in the range from 0.1 mm to 5.0 mm, both inclusive. An average height H of the convex portion 24 is in the range from 0.1 mm to 0.5 mm, both inclusive. And H≦W≦D/2 is met, where D is an average size of respective sides or diameters of the openings of the concave portions 23. Also, the total area of the top surface of the convex portion 24 preferably accounts for half or less of the entire surface area of the polishing pad body 21. Furthermore, the minimum width Wmin of the convex portion 24 should preferably be equal to or larger than the average height H of the convex portion 24. The reasons why these relationships should be established will be described in detail later.

First, the average size D of respective sides or diameters of the openings of the concave portions 23 will be described as a premise. The average size D is defined in respectively different manners depending on the specific shape of the opening of each concave portion 23. For example, if the planar shape of a concave portion 23 is square, then the average size D is equal to the length of each side. If the planar shape of a concave portion 23 is rectangular, then the average size D is an average between the longer and shorter sides thereof. If the planar shape of a concave portion 23 is polygonal, then the average size D is an average among respective diagonals thereof. If the planar shape of a concave portion 23 is circular, then the average size D is equal to the diameter thereof. And if the planar shape of a concave portion 23 is ellipsoidal, then the average size D is an average between the longer and shorter axes thereof.

(Reason why 0.1 mm≦W≦5.0 mm should be met)

If the average width W of the convex portion 24 of the polishing pad 20 is smaller than 0.1 mm, then the convex portion 24 is likely to enter the concave portions of the semiconductor wafer. As a result, the concave portions of the wafer are also polished unintentionally, the level difference of the wafer is harder to eliminate, and the performance of the pad 20 in planarizing the wafer greatly deteriorates. In contrast, if the average width W is 0.1 mm or more, then the convex portion 24 of the polishing pad 20 is less likely to enter the concave portions of the wafer. As a result, the performance of the pad 20 in planarizing the wafer improves.

On the other hand, suppose the average width W is larger than 5.0 mm. Then, even if the wafer is pressed against the pad 20, superfluous part of the polishing slurry, existing between the top surface of the convex portion 24 and the wafer, is more likely to remain on the top surface of the convex portion 24, thus causing hydroplaning. As a result, the wafer is floating over the pad 20, the abrasive grains, contained in the polishing slurry, hardly come into contact with the wafer and the polishing rate of the wafer considerably decreases. In contrast, suppose the average width W is 5.0 mm or less. Then, when the wafer is pressed against the pad 20, superfluous part of the polishing slurry, existing between the top surface of the convex portion 24 and the wafer, quickly moves from the top surface of the convex portion 24 into the concave portions 23. Accordingly, an appropriate amount of polishing slurry always exists between the top surface of the convex portion 24 and the wafer and the abrasive grains, contained in the polishing slurry, can come into contact with the wafer, thus increasing the polishing rate of the wafer.

(Reason why 0.1 mm≦H≦0.5 mm should be met)

If the average height H of the convex portion 24 of the polishing pad 20 is smaller than 0.1 mm, then the depth of the concave portions 23 is too small to store an appropriate amount of polishing slurry therein. That is to say, superfluous part of the polishing slurry, existing between the top surface of the convex portion 24 and the wafer, is more likely to remain on the top surface of the convex portion 24. As a result, the wafer is floating over the pad 20 and the polishing rate of the wafer considerably decreases. In contrast, suppose the average height H is 0.1 mm or more. Then, that superfluous part of the polishing slurry, existing between the top surface of the convex portion 24 and the wafer, can be stored in the concave portions 23 with much more certainty. As a result, the polishing rate of the wafer can be increased.

On the other hand, suppose the average height H is larger than 0.5 mm. Then, the polishing slurry, which is stored in the concave portions 23, is less likely to be introduced into the polishing regions between the top surface of the convex portion 24 and the wafer. That is to say, it becomes harder to supply fresh polishing slurry to the polishing regions, resulting in decrease in polishing rate. In contrast, suppose the average height H is 0.5 mm or less.

Then, the polishing slurry, which is stored in the concave portions 23, is more likely to be introduced into the polishing regions between the top surface of the convex portion 24 and the wafer. Accordingly, the polishing regions can always be supplied with fresh polishing slurry, resulting in increase in polishing rate.

(Reason why H≦W≦D/2 should be met)

Suppose the average height H of the convex portion 24 of the polishing pad 20 is larger than the average width W of the convex portion 24 thereof. Then, the convex portion 24 is more likely to be deformed when a relative velocity is caused between the pad 20 and the wafer during polishing. That is to say, the top surface of the convex portion 24 is less likely to come into contact with the wafer, thus decreasing the polishing rate of the wafer. In contrast, suppose the average height H is equal to or smaller than the average width W. Then, the convex portion 24 is less likely to be deformed even if a relative velocity is caused between the pad 20 and the wafer. That is to say, the top surface of the convex portion 24 can come into good contact with the wafer, thus increasing the polishing rate of the wafer.

On the other hand, suppose the average width W is of a size more than half of the average size D of respective sides or diameters of the openings of the concave portions 23. Then, the amount of polishing slurry stored in the concave portions 23 decreases. Accordingly, superfluous part of the polishing slurry, existing between the top surface of the convex portion 24 and the wafer, is more likely to remain on the top surface of the convex portions 24. As a result, the wafer is floating over the pad 20 and the polishing rate of the wafer greatly decreases. In contrast, suppose the average width W is of a size half or less of the average size D. Then, that superfluous part of the polishing slurry, existing between the top surface of the convex portion 24 and the wafer, can be stored in the concave portions 23 with much more certainty. As a result, the polishing rate of the wafer increases.

(Reason why the total area of the top surface of the convex portion 24 should be half or less of the entire surface area of the polishing pad body 21)

If the total area of the top surface of the convex portion 24 is half or less of the entire surface area of the polishing pad body 21, then the wafer receives larger pressure per unit area from the convex portion 24 of the polishing pad 20 when the wafer is pressed against the pad 20. As a result, the superfluous part of the polishing slurry, existing between the top surface of the convex portion 24 and the wafer, can be stored in the concave portions 23 with much more certainty. In addition, since the convex portions of the wafer can be ground by the abrasive grains contained in the polishing slurry with a lot more certainty, the polishing rate of the wafer increases.

(Reason why the minimum width Wmin of the convex portion 24 should be equal to or larger than the average height H of the convex portion 24)

If the minimum width Wmin of the convex portion 24 is equal to or larger than the average height H of the convex portion 24, then the convex portion 24 of the pad 20 does not enter the concave portions of the wafer. As a result, the performance of the pad 20 in planarizing the wafer improves.

(Method for manufacturing the polishing pad 20)

The polishing pad 20 may be manufactured in the following manner, for example. First, a large number of long tubes like straws, made of a non-foamed plastic with a thickness in the range from 0.1 mm to 5.0 mm, both inclusive, are tied up in a bundle and fixed to each other to form a regular pattern. Thereafter, these tubes are cut off to have a length in the range from 0.1 mm to 0.5 mm, both inclusive, thereby forming a group of cylindrical members 22. And then the group of cylindrical members 22 is adhered to the surface of a polishing pad body 21 made of a non-foamed plastic in the form of a plate.

(Relationship between the average width W of the convex portion 24 and the type of a film to be polished)

The foregoing size relationships are generally applicable irrespective of the type of the film to be polished. If the type of a film to be polished is specified, however, the average width W of the convex portion 24 should preferably be further limited within a narrower range.

If a silicon dioxide film should be polished, then 0.1 mm≦W≦0.5 mm should be met. This is because when a silicon dioxide film is polished by CMP, the film is polished due to not so much chemical factors as mechanical factors. That is to say, in order to promote mechanical polishing, the average width W should be smaller in such a case. Also, since a silicon dioxide film is hard, the convex portion 24 is less likely to be forced into the film to be polished even if the average width W is reduced.

On the other hand, if a copper or copper alloy film should be polished, then 0.5 mm≦W≦5.0 mm should be met. This is because when a copper or copper alloy film is polished by CMP, the film is polished due to not so much mechanical factors as chemical factors. That is to say, in order to promote chemical polishing, the contact area between the slurry and the wafer should be expanded by increasing the average width W of the convex portion 24. Also, since a copper or copper alloy film is soft, the convex portion 24 is possibly forced into the film to be polished if the average width W is small.

Furthermore, if a tungsten or tungsten silicide film should be polished, then 0.1 mm≦W≦2.0 mm should be met. This is because when a tungsten or tungsten silicide film is polished by CMP, the film is polished due to not so much chemical factors as mechanical factors compared with polishing a copper or copper alloy film. Also, a tungsten or tungsten silicide film is harder than a copper or copper alloy film. Accordingly, even if the average width W of the convex portion 24 is small, the convex portion 24 is less likely to be forced into the film to be polished in this case.

Embodiment 3

Figure 6:
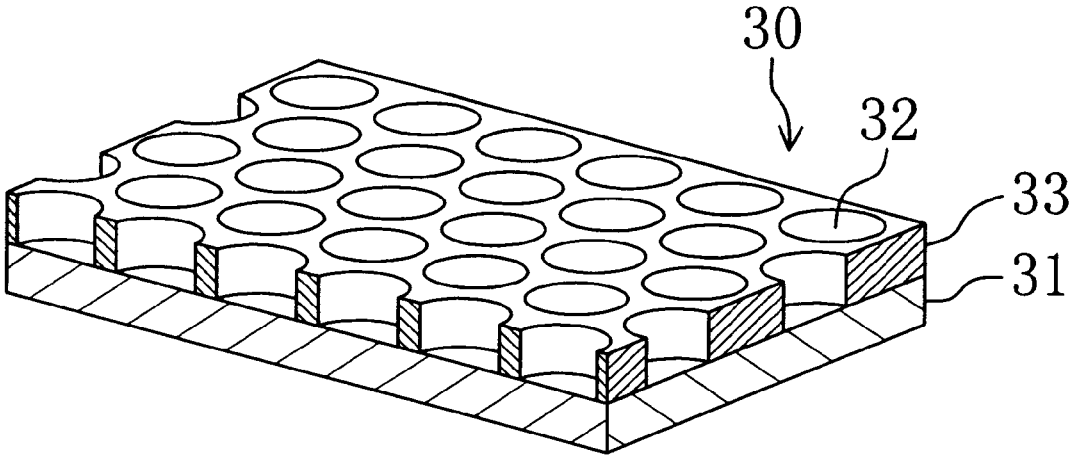
FIG. 6 is a perspective sectional view of a polishing pad for semiconductor wafer according to the third embodiment of the present invention.
Figure 7A:
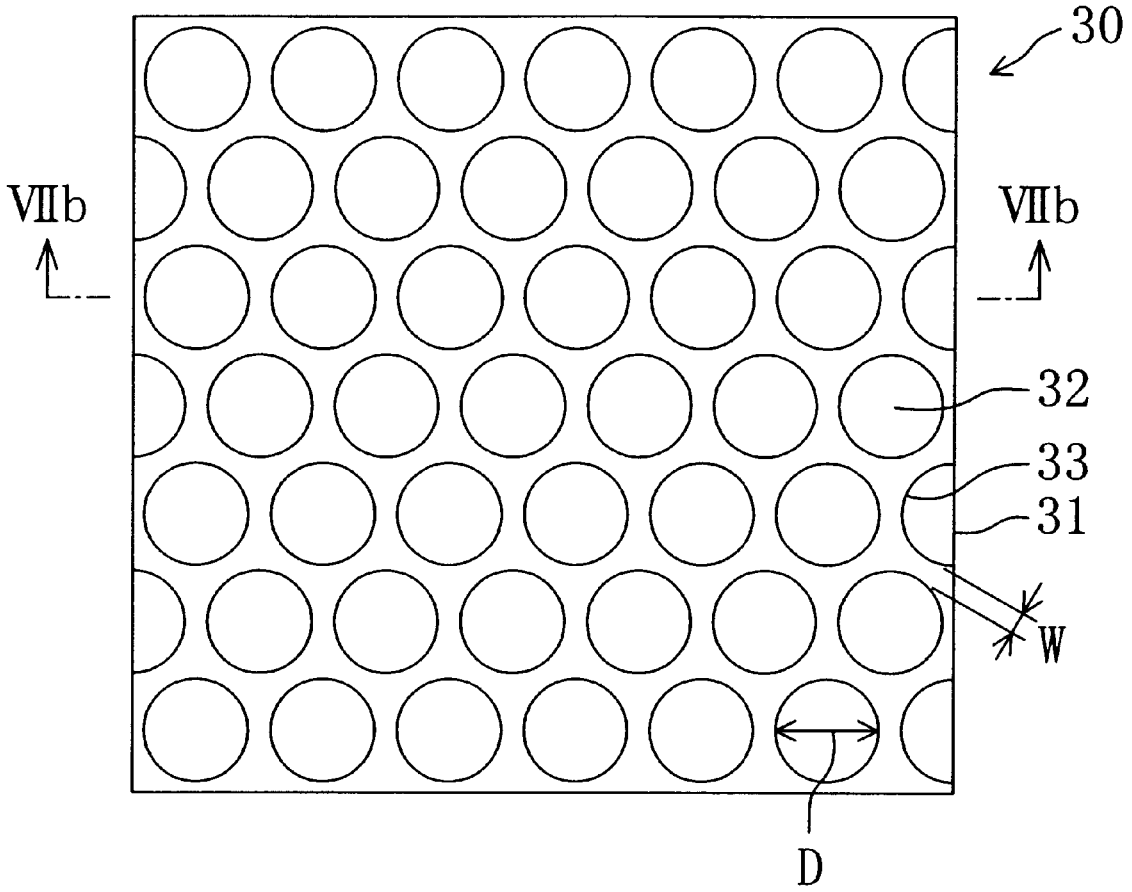
FIG. 7(*a*) is a plan view of the polishing pad of the third embodiment.
Figure 7B:
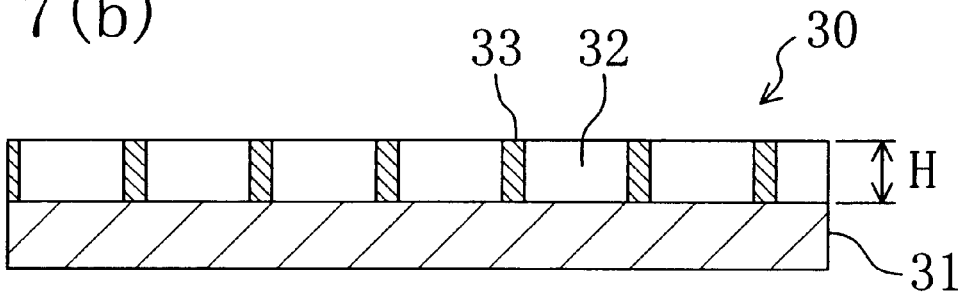

Next, a polishing pad for semiconductor wafer according to the third embodiment of the present invention will be described with reference to FIG. 6 and FIGS. 7(*a*) and 7(*b*). FIG. 6 is a perspective sectional view of a polishing pad 30 of the third embodiment. FIG. 7(*a*) is a plan view of the polishing pad 30; and FIG. 7(*b*) is a cross-sectional view thereof taken along the line VIIb—VIIb in FIG. 7(*a*).

The polishing pad 30 includes a polishing pad body 31, large number of concave portions 32 and a convex portion 33. The polishing pad body 31 is made of a non-foamed plastic such as polyurethane or acrylate resin. The concave portions 32 are independently provided on the surface of the polishing pad body 31 and can store the polishing slurry therein. And the convex portion 33 is continuously provided among the concave portions 32 on the surface of the polishing pad body 31. The shape of the opening of each concave portion 32 is not limited to any particular shape. That is to say, the concave portions 32 may be circular, ellipsoidal, square, rectangular or polygonal. Alternatively, a plurality of shapes may be applied to the concave portions 32 in combination. In the illustrated example, the concave portions 32 are circular.

In this embodiment, an average width W of the convex portion 33 is in the range from 0.1 mm to 5.0 mm, both inclusive. An average height H of the convex portion 33 is in the range from 0.1 mm to 0.5 mm, both inclusive. And H≦W≦D/2 is met, where D is an average size of respective sides or diameters of the openings of the concave portions 32. Also, the total area of the top surface of the convex portion 33 preferably accounts for half or less of the entire surface area of the polishing pad body 31. Furthermore, the minimum width Wmin of the convex portion 33 should preferably be equal to or larger than the average height H of the convex portion 33. The reasons why these relationships should be established are as explained in the second embodiment and will not be described herein.

The average size D of respective sides or diameters of the openings of the concave portions 32 is defined in respectively different manners depending on the specific shape of the opening of each concave portion 32. For example, if the planar shape of a concave portion 32 is square, then the average size D is equal to the length of each side. If the planar shape of a concave portion 32 is rectangular, then the average size D is an average between the longer and shorter sides thereof. If the planar shape of a concave portion 32 is polygonal, then the average size D is an average among respective diagonals thereof. If the planar shape of a concave portion 32 is circular, then the average size D is equal to the diameter thereof. And if the planar shape of a concave portion 32 is ellipsoidal, then the average size D is an average between the longer and shorter axes thereof.

The relationships between the average width W of the convex portion 33 and the types of films to be polished are also as explained in the second embodiment, and the description thereof will be omitted herein.

The polishing pad 30 may be manufactured by any of the following methods. For example, in accordance with a method, a polishing pad body 31, whose surface is still flat, may be pressed against a die having concave portions to receive respective parts of the polishing pad body 31 where the convex portion 33 should be formed. Another method is pouring a molding resin into a die having concave portions to shape respective parts of the polishing pad body 31 where the convex portion 33 should be formed. In accordance with still another method, a large number of long tubes are tied up in a bundle and fixed to each other to form a regular pattern and cut off to have a predetermined length, thereby forming a group of short cylindrical members. And then the group of short cylindrical members is adhered to the surface of a polishing pad body 31 in the form of a plate.

Embodiment 4

Figure 8:
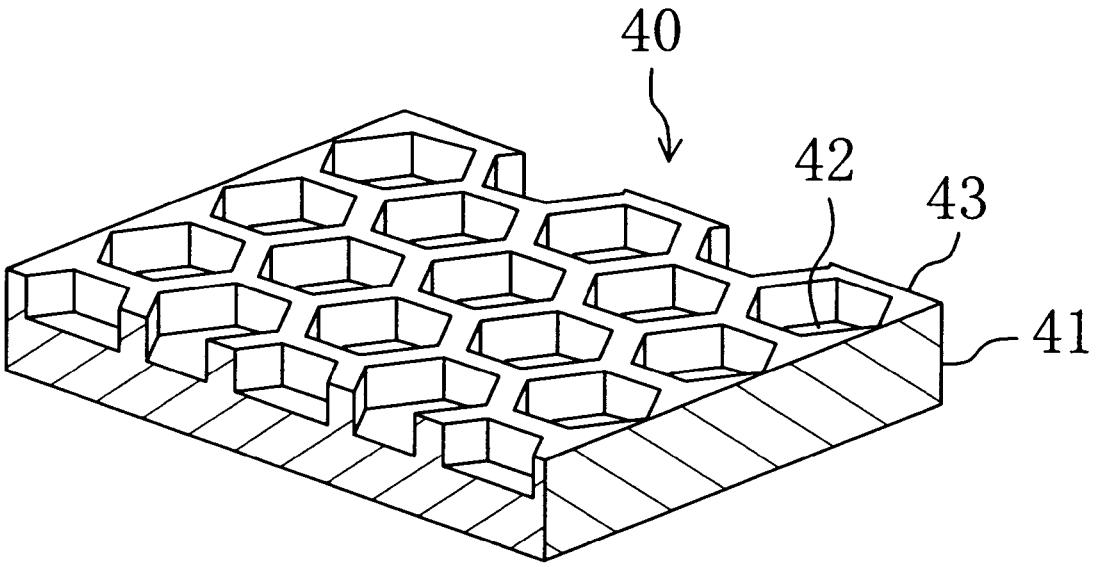
FIG. 8 is a perspective sectional view of a polishing pad for semiconductor wafer according to the fourth embodiment of the present invention.
Figure 9A:
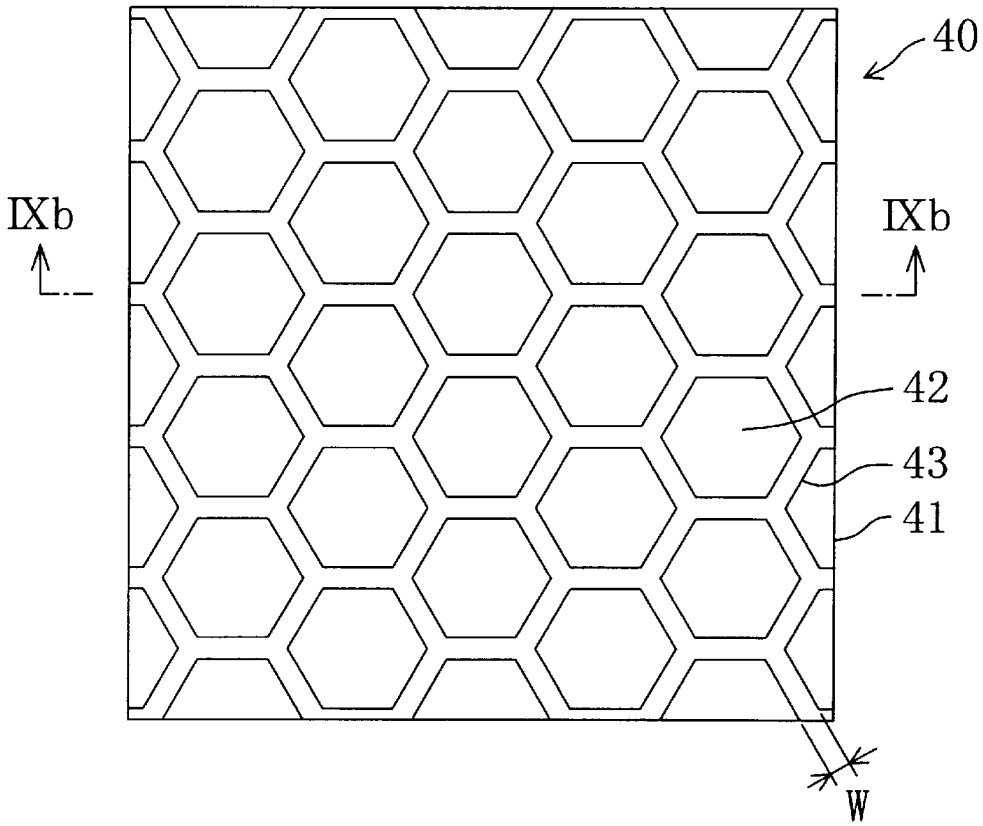
FIG. 9(*a*) is a plan view of the polishing pad of the fourth embodiment.
Figure 9B:
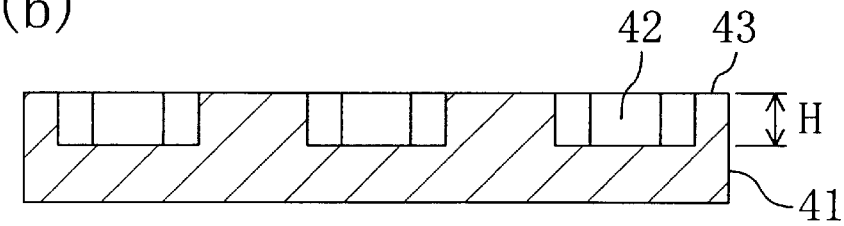
Figure 9C:
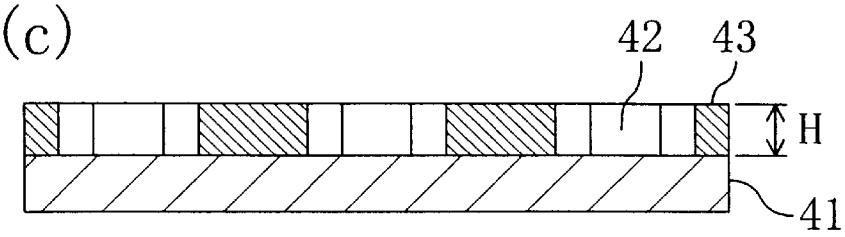
Figure 10:
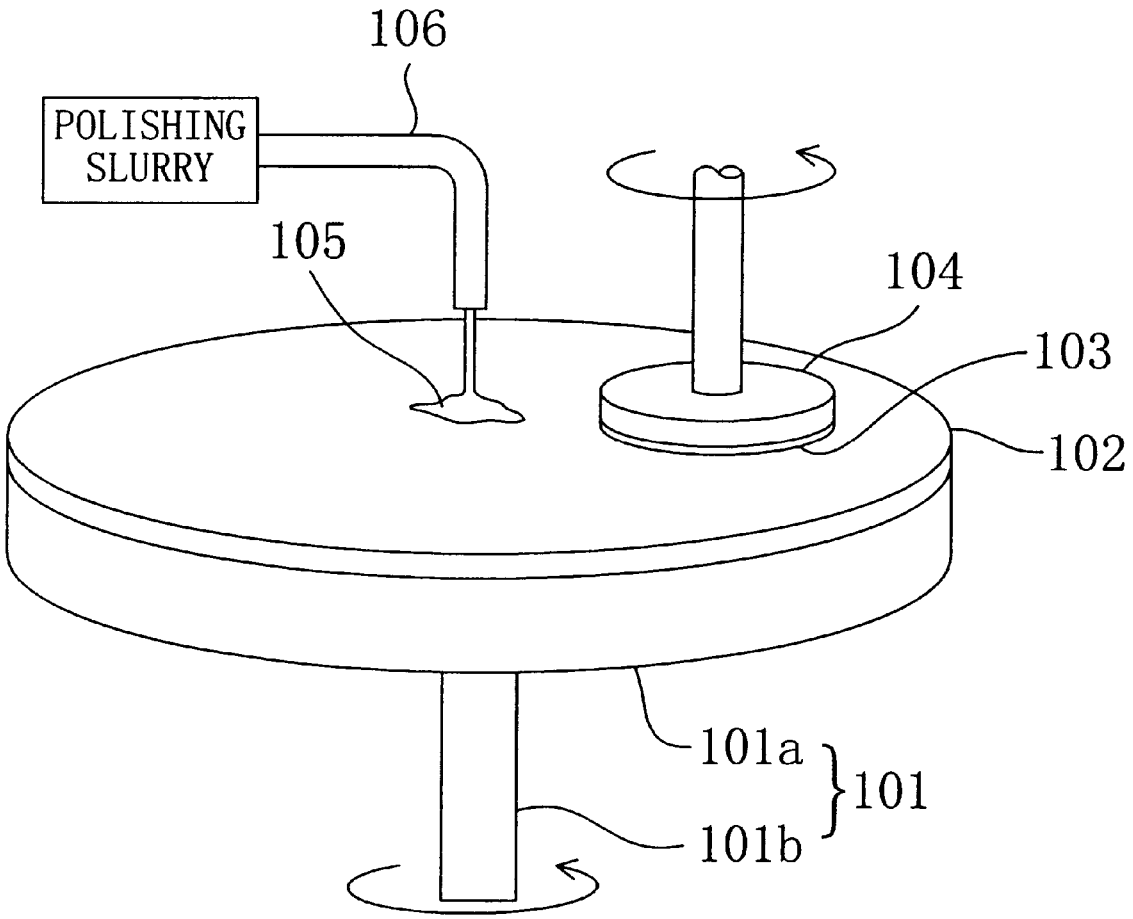
Fig. 10 Prior Art
FIG. 10 is a schematic perspective view of a conventional semiconductor wafer polisher.
Figure 11:
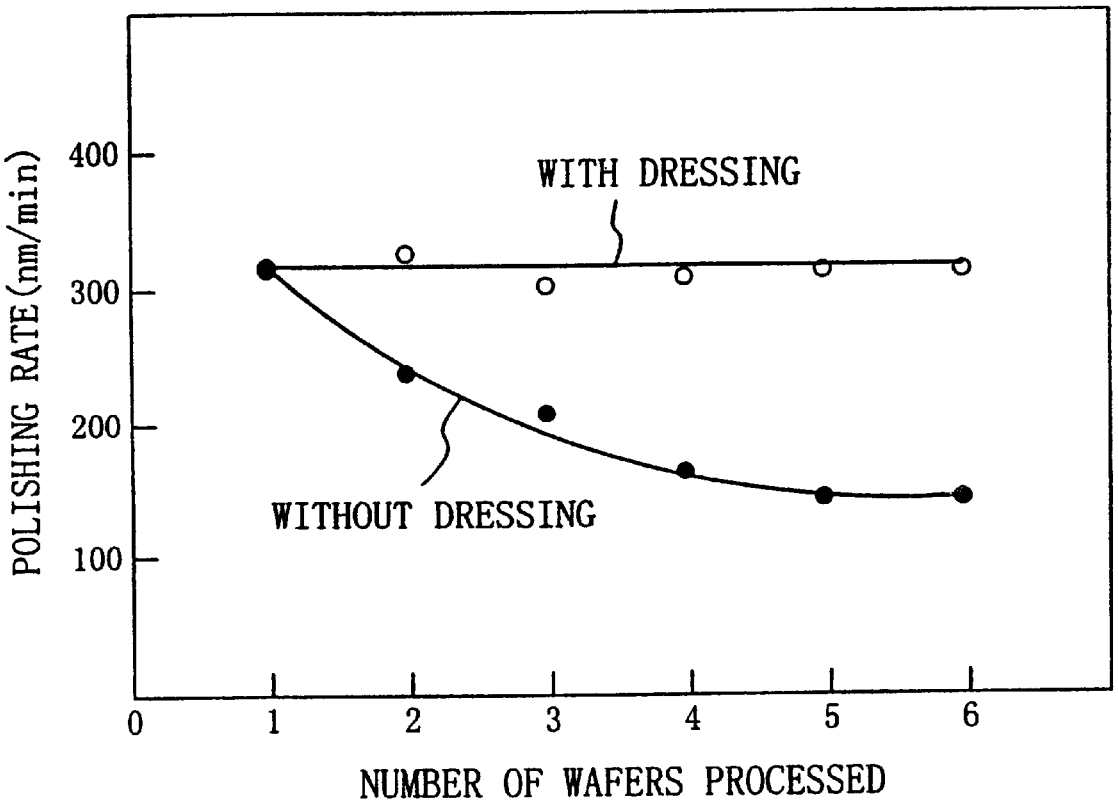
Fig. 11 PRIOR ART
FIG. 11 is a graph illustrating respective relationships between the number of wafers processed and the polishing rate with or without the conventional polishing pad dressed.

Next, a polishing pad for semiconductor wafer according to the fourth embodiment of the present invention will be described with reference to FIG. 8 and FIGS. 9(*a*) through 9(*c*). FIG. 8 is a perspective sectional view of a polishing pad 40 of the fourth embodiment. FIG. 9(*a*) is a plan view of the polishing pad 40. FIG. 9(*b*) is a cross-sectional view thereof taken along the line Ixb—IXb in FIG. 9(*a*). And FIG. 9(*c*) is another cross-sectional view thereof taken along the line Ixb—Ixb in FIG. 9(*a*).

The polishing pad 40 includes a polishing pad body 41, a large number of concave portions 42 and a convex portion 43. The polishing pad body 41 is made of a non-foamed plastic such as polyurethane or acrylate resin. The concave portions 42 are independently provided within the surface of the polishing pad body 41 and can store polishing slurry therein. And the convex portion 43 is continuously provided among the concave portions 42 on the surface of the polishing pad body 41. In the illustrated example, the opening of each concave portion 42 is hexagonal.

In this embodiment, an average width W of the convex portion 43 is in the range from 0.1 mm to 5.0 mm, both inclusive. An average height H of the convex portion 43 is in the range from 0.1 mm to 0.5 mm, both inclusive. And H≦W≦D/2 is met, where D is an average size of respective diagonals of the openings of the concave portions 42. Also, the total area of the top surface of the convex portion 43 preferably accounts for half or less of the entire surface area of the polishing 20 pad body 41. Furthermore, the minimum width Wmin of the convex portion 43 should preferably be equal to or larger than the average height H of the convex portion 43. The reasons why these relationships should be established are as explained in the second embodiment and will not be described herein. In this embodiment, the average size D of respective diagonals of the openings of the concave portions 42 is an average length of diagonals linking corresponding apexes together. The relationships between the average width W of the convex portion 43 and the types of films to be polished are also as explained in the second embodiment.

The polishing pad 40 may be manufactured by any of the following methods. For example, in accordance with a first method, a polishing pad body 41, whose surface is still flat, is pressed against a die having concave portions to receive respective parts of the polishing pad body 41 where the convex portion 43 should be formed. A second method is pouring a molding resin into a die having concave portions to shape respective parts of the polishing pad body 41 where the convex portion 43 should be formed. In accordance with a third method, a large number of long tubes are tied up in a bundle and fixed to each other to form a regular pattern and cut off to have a predetermined length, thereby forming a group of short cylindrical members. And then the group of short cylindrical members is adhered to the surface of a polishing pad body 41 in the form of a plate. In accordance with the first and second methods, a polishing pad 40 having such a cross-sectional structure as that shown in FIG. 9(*b*) is obtained. On the other hand, according to the third method, a polishing pad 40 having such a cross-sectional structure as that shown in FIG. 9(*c*) is obtained.

What is claimed is:

1. A polishing pad used for polishing a film on a semiconductor wafer and made of a plastic, the polishing pad comprising a polishing pad body, and a large number of convex portions, which are provided on a surface of the polishing pad body each having a flat top surface, wherein an average length L of the convex portions on each top surface thereof is in the range from 0.1 mm to 5.0 mm, inclusive; an average height H of the convex portions is in the range from 0.1 mm to 0.5 mm, inclusive; and $H \leqq L \leqq 2S$ is met where S is an average space between adjacent convex portions.

2. The polishing pad of claim 1, wherein a total area of the respective top surfaces of the convex portions accounts for half or less of an entire surface area of the polishing pad body.

3. A polishing pad used for polishing a film on a semiconductor wafer and made of a plastic, the polishing pad comprising:

a polishing pad body;

a large number of concave portions, which are independently provided on the surface of the polishing pad body and store polishing slurry; and a convex portion, which is continuously provided among the concave portions on the surface of the polishing pad body, wherein an average width W of the convex portion is in the range from 0.1 mm to 5.0 mm, inclusive; an average height H of the convex portion is in the range from 0.1 mm to 0.5 mm, inclusive; and $H \leqq W \leqq D/2$ is met, where D is an average size of openings of the concave portions.

4. The polishing pad of claim 3, wherein a total area of a top surface of the convex portion accounts for half or less of an entire surface area of the polishing pad body.

5. The polishing pad of claim 3, wherein a minimum width Wmin of the convex portion is equal to or larger than the average height H of the convex portion.

6. A method for polishing a semiconductor wafer comprising the step of polishing a film on the semiconductor wafer using a polishing pad made of a plastic, the polishing pad comprising:

a polishing pad body, and a large number of convex portions, which are provided on a surface of the polishing pad body each having a flat top surface, wherein an average length L of the convex portions on each top surface thereof is in the range from 0.1 mm to 5.0 mm, inclusive; an average height H of the convex portions is in the range from 0.1 mm to 0.5 mm, inclusive; and $H \leqq L \leqq 2S$ is met, where S is an average space between adjacent convex portions.

7. The method of claim 6, wherein a total area of the respective top surfaces of the convex portions accounts for half or less of an entire surface area of the polishing pad body.

8. The method of claim 6, wherein the film to be polished on the semiconductor wafer is a silicon dioxide film, and wherein the average length L is in the range from 0.1 mm to 0.5 mm, inclusive.

9. The method of claim 6, wherein the film to be polished on the semiconductor wafer is a copper film or a copper alloy film, and wherein the average length L is in the range from 0.5 mm to 5.0 mm, inclusive.

10. The method of claim 6, wherein the film to be polished on the semiconductor wafer is a tungsten film or a tungsten silicide film, and wherein the average length L is in the range from 0.1 mm to 2.0 mm, inclusive.

11. A method for polishing a semiconductor wafer comprising the step of polishing a film on the semiconductor wafer using a polishing pad made of a plastic, the polishing pad comprising:

a polishing pad body;

a large number of concave portions, which are independently provided on a surface of the polishing pad body and store polishing slurry; and a convex portion, which is continuously provided among the concave portions on the surface of the polishing pad body, wherein an average width W of the convex portion is in the range from 0.1 mm to 5.0 mm, inclusive; an average height H of the convex portion is in the range from 0.1 mm to 0.5 mm, inclusive; and $H \leqq W \leqq D/2$ is met, where D is an average size of openings of the concave portions.

12. The method of claim 11, wherein a total area of a top surface of the convex portion accounts for half or less of an entire surface area of the polishing pad body.

13. The method of claim 11, wherein a minimum width Wmin of the convex portion is equal to or larger than the average height H of the convex portion.

14. The method of claim 11, wherein the film to be polished on the semiconductor wafer is a silicon dioxide film, and wherein the average width W is in the range from 0.1 mm to 0.5 mm, inclusive.

15. The method of claim 11, wherein the film to be polished on the semiconductor wafer is a copper film or a copper alloy film, and wherein the average width W is in the range from 0.5 mm to 5.0 mm, inclusive.

16. The method of claim 11, wherein the film to be polished on the semiconductor wafer is a tungsten film or a tungsten silicide film, and wherein the average width W is in the range from 0.1 mm to 2.0 mm, inclusive.

* * * * *